US009437930B2

(12) United States Patent
Luo et al.

(10) Patent No.: US 9,437,930 B2
(45) Date of Patent: Sep. 6, 2016

(54) CIRCULAR POLARIZED ANTENNA STRUCTURE

(71) Applicant: LOROM INDUSTRIAL CO., LTD., Taipei (TW)

(72) Inventors: Shen-Kay Luo, Taipei (TW); Bing-Hao Zeng, Taipei (TW); Shu-Hsien Wu, Taipei (TW); Hao-Kui Zhu, Taipei (TW)

(73) Assignee: LOROM INDUSTRIAL CO., LTD., Taipei (TW)

( * ) Notice: Subject to any disclaimer, the term of this patent is extended or adjusted under 35 U.S.C. 154(b) by 95 days.

(21) Appl. No.: 14/531,173

(22) Filed: Nov. 3, 2014

(65) Prior Publication Data

US 2016/0126616 A1 May 5, 2016

(51) Int. Cl.
*H01Q 1/24* (2006.01)
*H01Q 9/04* (2006.01)

(52) U.S. Cl.
CPC ..... *H01Q 9/0492* (2013.01); *H01Q 9/0464* (2013.01)

(58) Field of Classification Search
CPC ..... H01Q 1/243; H01Q 23/00
USPC ..... 343/700 MS, 829, 846, 906
See application file for complete search history.

(56) References Cited

U.S. PATENT DOCUMENTS

| | | | | |
|---|---|---|---|---|
| 6,104,350 | A * | 8/2000 | Ng | H01Q 1/244 343/702 |
| 6,512,491 | B2 * | 1/2003 | Kanayama | H01Q 1/243 343/702 |
| 7,009,563 | B2 * | 3/2006 | Mori | H01Q 1/243 343/700 MS |
| 8,094,075 | B2 * | 1/2012 | Cheng | H01Q 9/0414 343/700 MS |
| 9,287,628 | B2 * | 3/2016 | Zeng | H01Q 1/38 |
| 2005/0285798 | A1 * | 12/2005 | van Wonterghem | H01Q 1/243 343/702 |
| 2009/0267841 | A1 * | 10/2009 | Liao | H01Q 9/0442 343/700 MS |

FOREIGN PATENT DOCUMENTS

TW I348783 9/2011

* cited by examiner

*Primary Examiner* — Tho G Phan
(74) *Attorney, Agent, or Firm* — Muncy, Geissler, Olds & Lowe, P.C.

(57) ABSTRACT

A circular polarized antenna structure is provided, including: an antenna having a main body, a protruding portion, and a stopping portion formed between the main body and the protruding portion; a base; a radiation conductor disposed on an upper surface of the base and having at least a first through hole formed above the via hole; a ground conductor disposed on a lower surface of the base and has at least a second through hole formed below the via hole; solder partially covering an end of the stopping portion opposing the main body and the first through hole; and colloid partially formed on the solder, the radiation conductor, and the upper surface of the base. The antenna penetrates the base, and the stopping portion abuts against the lower surface of the base, such that the antenna can be prevented from dropping due to the impact of an external force.

10 Claims, 5 Drawing Sheets

CIRCULAR POLARIZED ANTENNA STRUCTURE

BACKGROUND OF THE INVENTION

1. Field of the Invention

The present invention relates to antenna structures, and, more particularly, to an improved circular polarized antenna structure.

2. Description of Related Art

An antenna structure is an essential device for receiving different wireless signals, such as radio frequency, amplitude modulation frequency, Global Positioning Systems (GPS), Global Systems for Mobile Communications (GSM), wireless network (Wi-Fi), and for subsequent signal processing.

An antenna body may have a variety of shapes and structures in order to adapt to different sizes of wireless signal transmission/reception devices or ambient environments to obtain a greater signal gain. As such, circular polarized antennas have been developed to have a compact structure in view of different usages and applications.

Taiwanese Patent Publication No. 1348783 discloses a circular polarized plate antenna structure, i.e., a circular polarized antenna. There exists a technical defect in this kind of circular polarized antenna. For instance, in applications of such antennas to a GPS apparatus for vehicle use, it is necessary that the circular polarized antenna be disposed on a substrate in order to protrude from the base of the circular polarized antenna body, which necessitates provisions of corresponding through holes penetrating through the substrate for the antenna to be mounted thereon. However, if the circular polarized antenna body does not align precisely with the through hole in the assembly process, or the force imposed on the circular polarized antenna is toward the position of the substrate without the through hole, the bonding strength therebetween would not be strong enough to resist the counter force imposed on the circular polarized antenna body since the components are soldered together merely on the top end, the base and a radiation conductor, thereby adversely causing the circular polarized antenna to snap outwards and thus detach from the base and causing the damage and inferior yield of the product as a result.

To resolve the foregoing technical problem, it is beneficial to propose a novel circuit polarized antenna that has sufficient inherent structural strength for resisting and rebutting the counter force in the assembly process.

SUMMARY OF THE INVENTION

In view of the drawbacks associated with the prior techniques, the present invention proposes a novel circuit polarized antenna structure, which comprises an antenna, a base, a radiation conductor and a ground conductor formed on an upper surface and a lower surface of the base, respectively, solder, and colloid.

The antenna comprises a main body, a protruding portion, and a stopping portion formed between the main body and the protruding portion. The base has at least a via hole corresponding in size to the main body, and the antenna can thus penetrate the base. The stopping portion abuts against the lower surface of the base, such that the antenna can be prevented from dropping due to the impact from an external force. The radiation portion has at least a first through hole formed above the via hole. The ground portion has at least a second through hole formed below the via hole. The solder is partially formed on an end of the stopping portion opposing the main body and the first through hole. The colloid is partially formed on the solder, the radiation conductor, and the upper surface of the base.

In an embodiment, the via hole has a recessed portion formed on an end thereof close to the second through hole, the main body penetrates the via hole and the second through hole, and the stopping portion abuts against the recessed portion.

In an embodiment, the protruding portion has a cross-sectional area slightly smaller than a cross-sectional area of the main body.

In an embodiment, the main body has an extension portion formed on an end thereof opposing the stopping portion.

In an embodiment, the via hole has a recessed portion formed on an end close to the second through hole, the main body and the extension portion penetrate the via hole and the second through hole, and the stopping portion abuts against the recessed portion.

In an embodiment, the solder is partially formed on an end of the main body opposing the stopping portion and the extension portion, and is further formed in a space among the end of the main body opposing the stopping portion, the extension portion and the first through hole, and the stopping portion abuts against the recessed portion.

In an embodiment, the cross-sectional area of the extension portion is slightly smaller than the cross-sectional area of the main body.

In an embodiment, an end of the main body opposing the stopping portion can be a plane, an arc, a tapered, or a ladder structure.

In an embodiment, the extension portion has a ladder, tapered, or arc structure extending from an end of the main body opposing the stopping portion.

Compared to prior art, the circular polarized antenna structure according to the present invention is characterized by employing a stopping portion structure that, when incorporated with the base, abuts against a surface of the base facing the via hole of the base, and further employing the colloid which is formed on the solder, the radiation conductor, and the upper surface of the base. Therefore, during the assembly, the reaction force of the main body of the circular polarized antenna can be coped with, thereby fastening the circular polarized antenna on the base. In addition, the circular polarized antenna according to the present invention can further includes an extension portion to allow the solder to flow into the through hole of the base and incorporated to the radiation conduction to thus increase the contact surface area of the solder and the base and the radiation conductor, thereby increasing the bonding strength of the circular polarized antenna body and the base as well as the transmission efficiency of wireless signals.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The following illustrative embodiments are provided to illustrate the disclosure of the present invention, these and other advantages and effects can be understood by persons skilled in the art after reading the disclosure of this specification. Note that the structures, proportions, sizes depicted in the accompanying figures merely serve to illustrate the disclosure of the specification to allow for comprehensive reading without a limitation to the implementation or applications of the present invention, and does not constitute any substantial technical meaning.

Figure 1A:
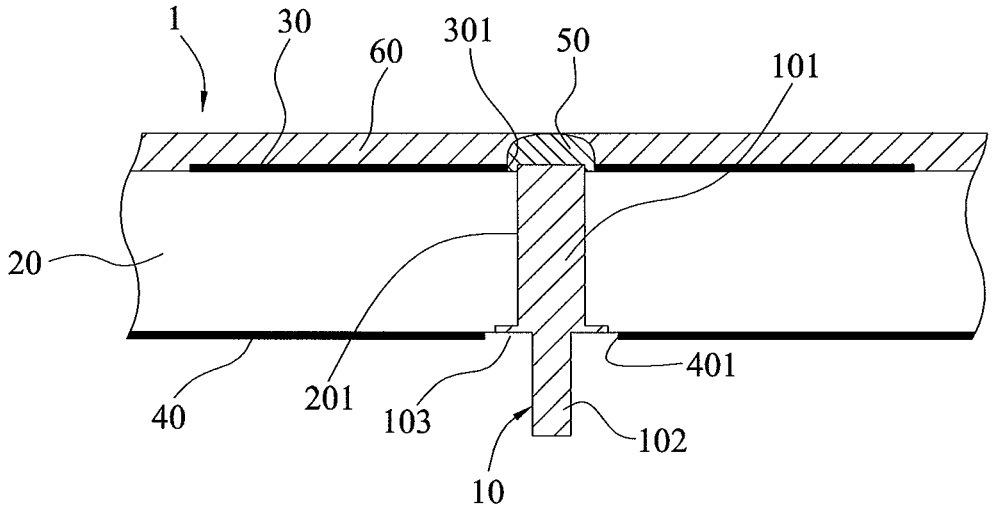
FIG. 1*a* is a cross-sectional view of a circular polarized antenna structure in accordance with a first embodiment of the present invention.

Referring to FIG. 1*a*, a cross-section view of a circular polarized antenna structure 1 in accordance with a first embodiment of the present invention is shown. In an embodiment, the circular polarized antenna structure 1 comprises an antenna 10, a base 20, a radiation conductor 30, a ground conductor 40, solder 50, and colloid 60. The base 20 can be made of a ceramic material, and the radiation conductor 30 and the ground conductor 40 can be made of a silver material. The material mentioned above can be replaced with other materials according to the actual application.

Figure 1B:
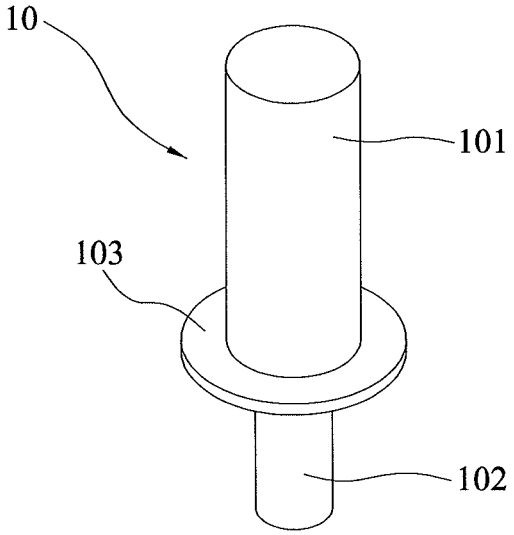
FIG. 1*b* is a schematic diagram of the circular polarized antenna structure in accordance with the first embodiment of the present invention.

Referring to FIG. 1*b*, an antenna 10 comprises a main body 101, a protruding portion 102, and a stopping portion 103 formed between the main body 101 and the protruding portion 102. As shown in FIG. 1*a*, the base 20 has at least a via hole 201 corresponding in size to the main body 101, the antenna 10 can thus penetrate the base 20, and the stopping portion 103 abuts against a lower surface of the base 20, to prevent the dropping of the antenna 10 due to an external force impact. Moreover, the radiation conductor 30 and the ground conductor 40 are formed on the upper and lower surfaces of the base 20, respectively. The radiation conductor 30 has at least a first through hole 301 formed above the via hole 201. The ground conductor 40 has at least a second through hole 401 formed below the via hole 201. The solder 50 is partially formed on an end of the main body 101 opposing stopping portion 103 and the first through hole 301. The colloid 60 can be formed on the solder 50, the radiation portion 30, and the upper surface of the base 20. In another embodiment, the colloid 60 can also be partially formed on the solder 50, the radiation portion 30, and/or the upper surface of the base 20.

As shown in FIG. 1*b*, the end of the main body 101 opposing the stopping portion 103 has a plane structure. In another embodiment, the plane structure can be replaced with, but not limited to, an arc structure, a tapered structure, or a ladder structure (not shown) according to the actual application.

Figure 1C:
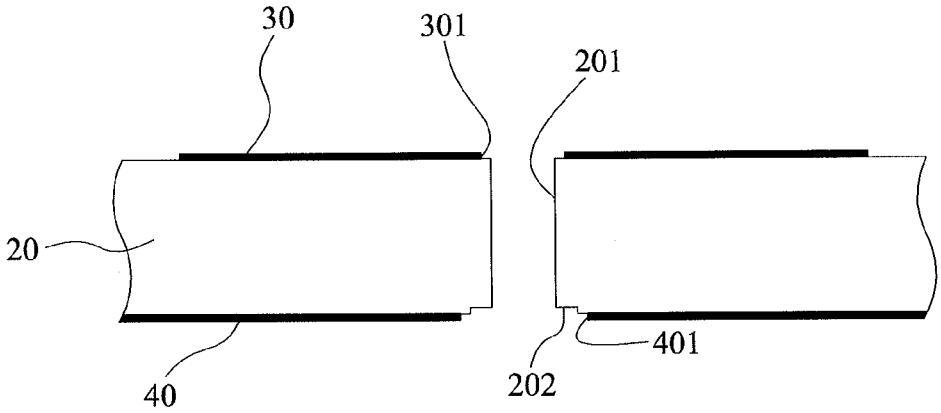
FIGS. 1*c*-1*e* is a cross-section view illustrating the combination of an antenna with a base of the circular polarized antenna structure in accordance with the first embodiment of the present invention.
Figure 1D:
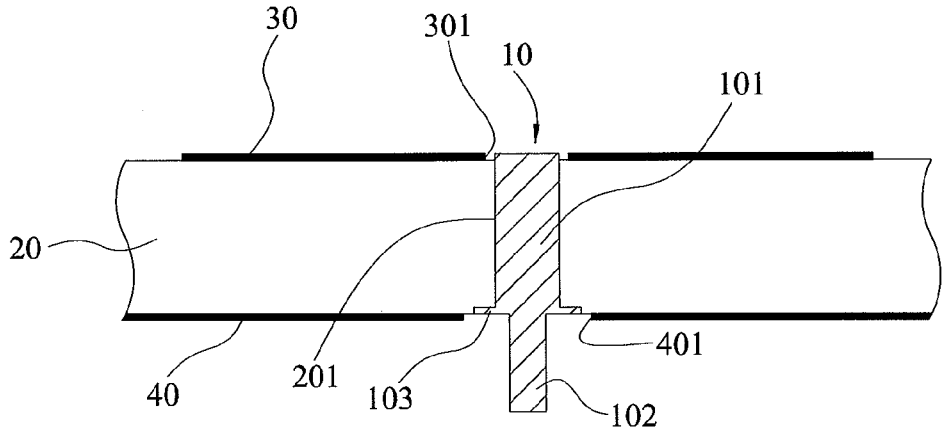
Figure 1E:
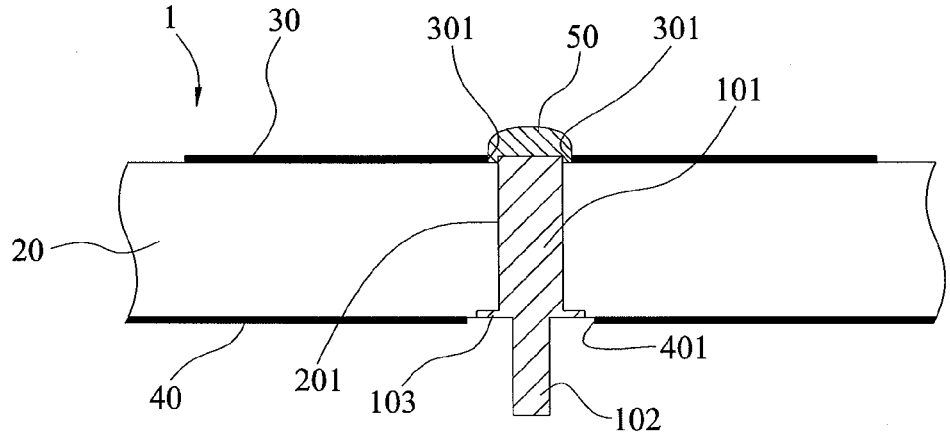

Please refer to FIGS. 1*c*-1*e*. As shown in FIG. 1*c*, the via hole 210 of the base 20 has a recessed portion 202 formed on an end thereof close to the second through hole 401 of the ground conductor 40. The recessed portion 201 constitutes a space for the stopping portion 102 to be accommodating therein such that the stopping portion 102 and the lower surface of the base 20 are coplanar. The cross-sectional area of the recessed portion 202 may be equal to or slightly larger than the cross-sectional area of the stopping portion 103, and the height of the recessed portion 202 may be equal to, slightly smaller than, or slightly larger than the height of the stopping portion 103.

As shown in FIG. 1*d*, the main body 101 of the antenna 10 can penetrate the via hole 201 and the second through hole 401. In an embodiment, an end of the main body 101 of the antenna 10 penetrates the second through hole 401, passes though the via hole 201, and is exposed from the first through hole 301, and the stopping portion 103 of the antenna 10 abuts against the recessed portion 202.

As shown in FIG. 1*e*, the solder 50 can be formed on the end of the main body 101 opposing the stopping portion 103 and the peripheral of the first through hole 301, and the stopping portion 103 abuts against the end of the via hole 201 close to the second through hole 401, thereby fastening the antenna 10 onto the base 20.

In an embodiment, the thickness of the colloid 60 may be equal to or slightly smaller than the thickness of the solder 50, to expose the surface formed of the colloid 60, thereby increasing the transmission efficiency of wireless signals. In another embodiment, the thickness of the colloid 60 may be slightly larger than the thickness of the solder 50 according to the actual application, thereby the colloid 60 completely covering the solder 50.

In an embodiment, the main body 101, the protruding portion 102, and the stopping portion 103 may be cylindrical, as shown in FIG. 1*b*, the cross-sectional area of the protruding portion 102 may be slightly smaller than the cross-sectional area of the main body 101, and the cross-sectional area of the stopping portion 103 may be slightly larger than the cross-sectional area of the main body 101, to bring the stopping effect.

In another embodiment, the main body 101, the protruding portion 102, and the stopping portion 103 may be in the shape of a polygon column according to the actual application, and the cross-sectional area of the protruding portion 102 may be slightly larger than or equal to the cross-sectional area of the main body 101.

Figure 2A:
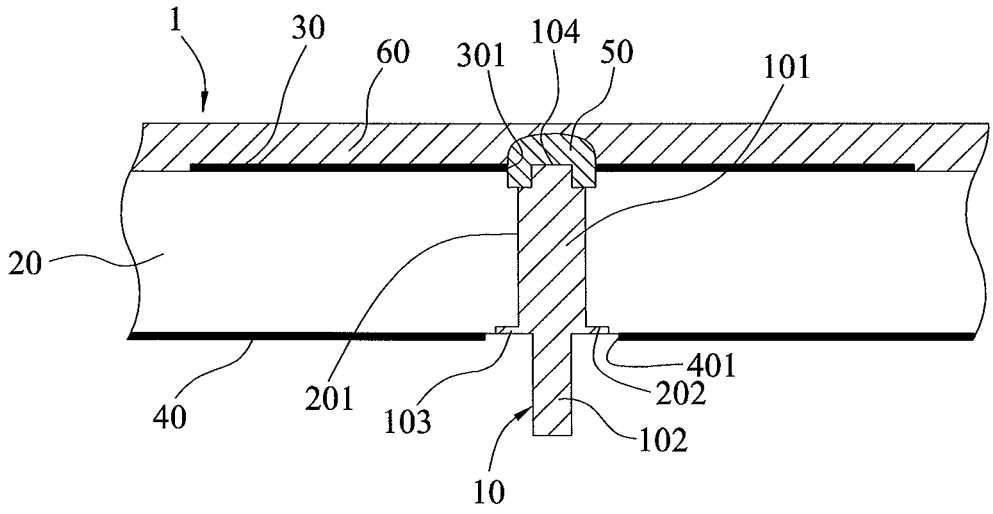
FIG. 2*a* is a cross-section view of a circular polarized antenna structure in accordance with a second embodiment of the present invention.
Figure 2B:
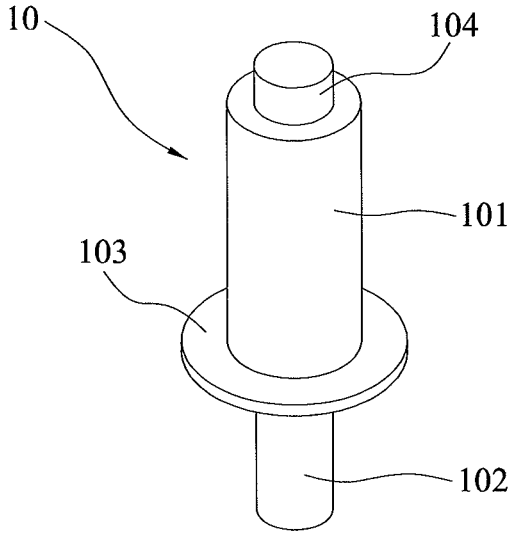
FIG. 2*b* is a schematic diagram of the circular polarized antenna structure in accordance with the second embodiment of the present invention.

Referring to FIGS. 2*a* and 2*b*, the circular polarized antenna structure 1 of a second embodiment according to the present invention is shown. The second embodiment differs from the first embodiment in that an extension portion 104 is additionally formed on the end of the main body 101 opposing the stopping portion 103.

Similarly, FIG. 2*a* shows that the via hole 201 of the base 20 may also have a recessed portion 202 formed on an end thereof close to the second through hole 401. When the antenna 10 is assembled to the base 20, the end of the main body 101 of the antenna 10 that has the extension portion 104 penetrates the second through hole 401, passes through the via hole 201, and is exposed from the first through hole 301, and the stopping portion 103 of the antenna 10 abuts against the recessed portion 202.

In an embodiment, the solder 50 is formed the an end of the main body 101 opposing the stopping portion 103, the extension portion 104, and the peripheral of the first through hole 201, and the stopping portion 103 abuts against the end of the via hole 201 close to the second through hole 401. In another embodiment, the solder 50 can be partially formed on the end of the main body 101 opposing the stopping portion 103 and/or the extension portion 104, the solder 50 is formed in the space between the end of the main body 101 opposing the stopping portion 103, the extension portion

104, and the first through hole 201, and the stopping portion 103 abuts against the recessed portion 202.

Compared with the first embodiment, the second embodiment discloses that the solder 50 can go deeper into the via hole 201, and can even fill the space between the end of the main body 101 opposing the stopping portion 103, the extension portion 104, and the first through hole 301, and the stopping portion 103 abuts against the recessed portion 202, thereby increasing the structural strength of the antenna 10 to resist exterior counter forces, but also have a greater signal gain due to the expansion of the contact surface area of the antenna 10 and the radiation conductor 30 by the solder 50 thereby enhancing the wireless signal transmission efficiency.

In another embodiment, the cross-sectional area of the extension portion 104 may be slightly smaller than the cross-sectional area of the main body 101 as shown in FIG. 2*b*, or be equal to or slightly larger than the cross-section surface area of the protruding portion 102, and the cross-sectional area of the protruding portion 102 may be also slightly smaller than the cross-sectional area of the main body 101 as shown in FIG. 2*b*.

In an embodiment, the shape and structure of the extension portion 104 can be modified or changed according to the actual application. Therefore, the extension portion 104 is not limited to the ladder structure or the like as shown in FIG. 2*b*. In another embodiment, the extension portion 104 may be, but not limited to, a tapered or an arc structure (not shown) extending form the end of the main body opposing the stopping portion.

To sum up, by employing a stopping portion to abut against a surface the base facing the via hole of the substrate when assembling the base, and the combination of solder and formation of colloid, thereby fastening the circular polarized antenna structure onto the base during the assembling process. In addition, the circular polarized antenna structure of the present invention can further comprises a extension portion, which allows solder paste to flow onto the via hole of the base to be incorporated with the radiation conductor and thus increase the contact surface area of the solder, the base, and the radiation conductor thereby enhancing the structural strength and wireless signal transmission efficiency of the circular polarized antenna.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A circular polarized antenna structure, comprising:

an antenna, comprising:

a main body;

a protruding portion; and a stopping portion formed between the main body and the protruding portion;

a base having at least a via hole corresponding to the main body;

a radiation conductor disposed on an upper surface of the base, and having at least a first through hole formed above the via hole;

a ground conductor disposed on a lower surface of the base, and having at least a second through hole below the via hole;

solder at least partially covering an end of the main body opposing the stopping portion and the first through hole; and colloid at least partially formed on the solder, the radiation conductor, and the upper surface of the base, wherein the end of the main body opposing the stopping portion has a plane, arc, tapered, or ladder structure.

2. The circular polarized antenna structure as claimed in claim 1, wherein the via hole has a recessed portion formed on an end thereof close to the second through hole.

3. The circular polarized antenna structure as claimed in claim 2, wherein the main body penetrates the second through hole and the via hole, and the stopping portion of the antenna abuts against the recessed portion.

4. The circular polarized antenna structure as claimed in claim 1, wherein the protruding portion has a cross-sectional area slightly smaller than a cross-sectional area of the main body.

5. The circular polarized antenna structure as claimed in claim 1, wherein the end of the main body opposing the stopping portion has an extension portion.

6. The circular polarized antenna structure as claimed in claim 5, wherein the via hole has a recessed portion formed on an end thereof close to the second through hole.

7. The circular polarized antenna structure as claimed in claim 6, the main body and the extension portion penetrate the second through hole and the via hole, and the stopping portion of the antenna abuts against the recessed portion.

8. The circular polarized antenna structure as claimed in claim 6, wherein the solder is partially formed on the end of the main body opposing the stopping portion and the extension portion, and is further formed in a space among the end of the main body opposing the stopping portion, the extension portion and the first through hole, and the stopping portion abuts against the recessed portion.

9. The circular polarized antenna structure as claimed in claim 5, wherein the extension portion has a cross-sectional area slightly smaller than a cross-sectional area of the main body, and the protruding portion has a cross-sectional area slightly smaller than the cross-sectional area of the main body.

10. The circular polarized antenna structure as claimed in claim 5, wherein the extension portion has a tapered or arc structure extending from the end of the main body opposing the stopping portion.

* * * * *